US009677730B2

(12) United States Patent
Chang

(10) Patent No.: US 9,677,730 B2
(45) Date of Patent: Jun. 13, 2017

(54) VEHICULAR LIGHT SYSTEM

(71) Applicants: AG WORLD CORP, New Taipei (TW); Yung-Lung Chang, Tainan (TW)

(72) Inventor: Yung-Lung Chang, Tainan (TW)

(73) Assignees: AG World Corp., New Taipei (TW); Yung-Lung Chang, Tainan (TW)

( * ) Notice: Subject to any disclaimer, the term of this patent is extended or adjusted under 35 U.S.C. 154(b) by 0 days.

(21) Appl. No.: 14/308,547

(22) Filed: Jun. 18, 2014

(65) Prior Publication Data

US 2015/0369443 A1 Dec. 24, 2015

(51) Int. Cl.
*F21S 8/10* (2006.01)

(52) U.S. Cl.
CPC ..... *F21S 48/1104* (2013.01); *F21S 48/1109* (2013.01); *F21S 48/1159* (2013.01); *F21S 48/1208* (2013.01); *F21S 48/1233* (2013.01); *F21S 48/1305* (2013.01); *F21S 48/137* (2013.01); *F21S 48/321* (2013.01); *F21S 48/328* (2013.01)

(58) Field of Classification Search
CPC ..... F21S 48/1104; F21S 48/1109; F21S 48/1159; F21S 48/1208; F21S 48/1233; F21S 48/1305; F21S 48/137; F21S 48/321; F21S 48/328; F21V 29/00; F21V 29/002; F21V 29/2212; F21V 29/503; F21V 29/70; F21V 29/74; F21V 29/763; H01L 33/64
See application file for complete search history.

(56) References Cited

U.S. PATENT DOCUMENTS

| | | | | |
|---|---|---|---|---|
| 7,281,823 | B2 * | 10/2007 | Moisel | F21S 48/1136 362/294 |
| 7,371,964 | B2 * | 5/2008 | Albou | F21S 48/1159 174/16.3 |
| 7,607,801 | B2 * | 10/2009 | Suehiro | F21K 9/00 362/294 |
| 8,246,225 | B2 | 8/2012 | Chang | |
| 9,133,999 | B2 * | 9/2015 | Abe | F21S 48/1317 |
| 2006/0120094 | A1 | 6/2006 | Tsukamoto et al. | |
| 2007/0279910 | A1 * | 12/2007 | Lin | F21V 7/0008 362/298 |

* cited by examiner

*Primary Examiner* — Bao Q Truong
(74) *Attorney, Agent, or Firm* — J.C. Patents

(57) ABSTRACT

A car lamp includes a housing provided with an optical reflecting surface for reflecting light produced by LED lamps to have the light passing through an optical panel and projected outward. The car lamp has a heat-dissipating member fixed between the housing and the optical panel and installed thereon with LED lamps. The heat-dissipating member has its front end disposed with an auxiliary heat sink that extends in a reserved space of the optical panel and firmly combined with the optical panel. Thus, the auxiliary heat sink is able to directly contact with normal-temperature outside air for elevating heat dissipation effect and prolonging service life of the car lamp.

22 Claims, 7 Drawing Sheets

VEHICULAR LIGHT SYSTEM

BACKGROUND OF THE INVENTION

1. Field of the Invention

This invention relates to vehicular lighting system, particularly to one having a housing provided with an optical reflecting surface for reflecting the light produced by LED lamps to have the light passing through an optical panel and projected out for illumination. A heat-dissipating member secured between the housing and the optical panel is installed with LED lamps and has its front end disposed with an auxiliary heat-sink that extends in a reserved space of the optical panel and combined together with the optical panel. Thus, the auxiliary heat-sink's direct contact with atmospheric temperatures enables enhanced heat dissipation effect and prolongs the service life of the LED lamps.

2. Description of the Prior Art

At present, LED lamps are employed as light sources for a car. Since the light intensity of one single LED lamp is impossible to offer enough lumen; therefore, a plurality of LED lamps have to be installed in a lamp housing for collective operation so as to produce appropriate amount of illuminance (LUX) and thus, after these LED lamps are started to emit light, high temperature will be produced and in this case, it is necessary to try to get rid of the high temperature produced by the light emitted by LED lamps and also needs to lower the temperature of the LED lamps in a shining state so as to maintain due operating temperature of the LED lamps. The optimum condition of photoelectric conversion efficiency of the LED lamps is preferably to keep the temperature of the thermal pad at 25° C. When the temperature of a packaging base plate continues to rise, the photoelectric conversion efficiency of the LED lamps will become lower. Generally, if the operating temperature of the LED lamps is around 110° C., the LED lamps can maintain about 80% of photoelectric conversion efficiency and, the higher the operating temperature is, the lower the photoelectric convention efficiency of the LED lamps will become and as a result, the LED lamps will quickly become weakened and impossible to produce enough photoelectric conversion efficiency and finally will result in trouble and damage. Therefore, a common problem confronted by using current LEDs as illuminating lamps is how to quickly dissipate high temperature of operating LED lamps, how to maintain excellent photoelectric conversion efficiency and how to prolong the service life of the LED lamps.

Therefore, for preventing LED lamps from becoming weakened quickly, the LED lamps, as disclosed in a U S patent No. 2006120094 A1, titled "Vehicular illumination lamp", and in anther U.S. Pat. No. 8,246,225 B2, title "Head Light or fog light for motorcycles and automobiles", are combined with a large-area heat-dissipating member for directly and quickly guide and dissipate high temperature produced by the LED lamps. However, in foresaid two U.S. patents, the heat-dissipating member is covered by an optical panel and a lamp housing (Actually, it is a common problem of conventional vehicular lighting systems using LED lamps); therefore, the heat-dissipating member can only have the heat source of the LED lamps guided to the lamp housing and then, by the lamp housing contacting with outside air of normal temperature to have high temperatures dissipated outward. Nevertheless, such a method of heat dissipation is only to have the lamp housing serving as a main heat-dissipating member so it is obvious that the structure of the conventional car lamp is insufficient in heat dissipation, especially to vehicular lighting systems that need comparatively large illumination and that is limited and contracted in volume. Therefore, the conventional LED lamps are likely to become weakened quickly and damaged due to inefficient heat dissipation.

For this reason, the inventor of this invention, having much experience in designing and manufacturing lighting systems, understands and researches the problem of heat dissipation efficiency of vehicular lighting systems and hence devised this invention.

SUMMARY OF THE INVENTION

The objective of this invention is to offer a vehicular lighting system provided with a heat-dissipating member able to contact with a great quantity of normal-temperature outside air. Thus, high temperature produced by LED lamps in a photoelectric conversion process can be quickly guided and dissipated outward for maintaining proper operating temperature and due photoelectric conversion efficiency of the LED lamps, able to enhance heat-dissipation effect of the LED lamps and prolong the service life of the LED lamps.

The vehicular lighting system in the present invention includes a housing provided with an optical reflecting surface for reflecting light produced by LED lamps to have the light passing through an optical panel and projected outward for lighting. The vehicular lighting system has a heat-dissipating member secured between the housing and the optical panel and installed with LED lamps. The heat-dissipating member has its front end disposed with an auxiliary heat sink extending in a reserved space of the optical panel and firmly combined with the optical panel. Thus, the auxiliary heat sink can directly contact with normal-temperature outside air, able to elevate heat dissipation effect of the LED lamps and prolong the service life of the LED lamps.

The special feature of this invention is that the optical panel is formed with a reserved space for receiving the auxiliary heat sink. The optical panel can be a single piece or composed of plural pieces, and the reserved space of the optical panel can be of a square shape, a triangular shape, a round shape, a rhombic shape, a rectangular shape, a cross shape, an X shape or an irregular shape for matching the shape of the auxiliary heat sink to enable the optical panel and the auxiliary heat sink of the heat-dissipating member to be combined together, thus maintaining properties of light transmission and water resistance of the optical panel.

The vehicular lighting system of this invention has the lamp housing combined with the heat-dissipating member so heat produced by the LED lamps can guided to the housing by the heat-dissipating member for producing multiple heat-dissipating channels, able to elevate heat dissipation efficiency, maintain proper photoelectric conversion efficiency and prolong the service life of the LED lamps.

The heat-dissipating member and the auxiliary heat sink of the vehicular lighting system in the present invention can be formed integrally, or the heat-dissipating member and the auxiliary heat sink respectively can be an independent member and then combined together with hardware or adhesives. Thus, heat source that the heat-dissipating member absorbs from the LED lamps can be directly guided and dissipated more efficiently.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
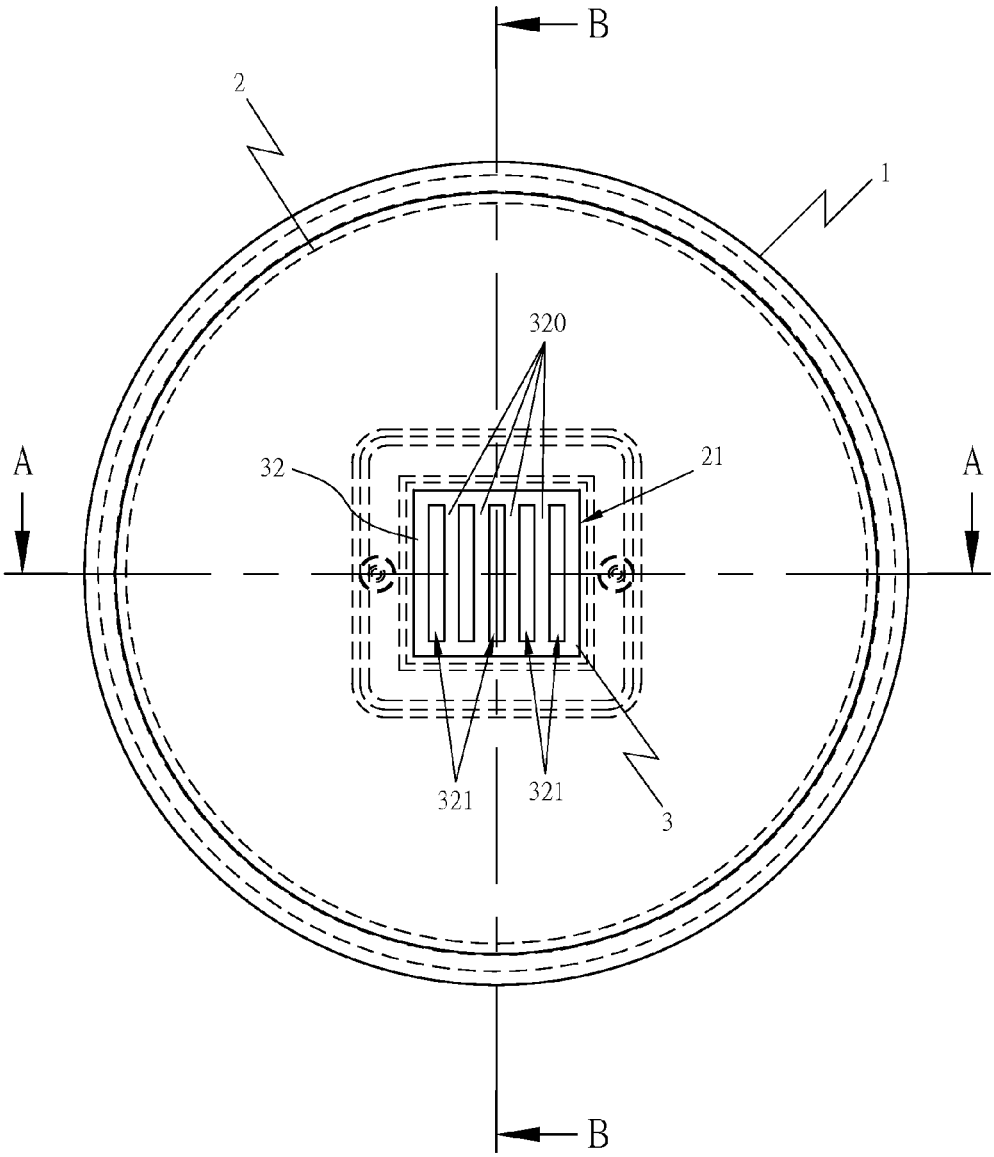
FIG. 1 is a front view of a first preferred embodiment of a vehicular lighting system in the present invention.

A first preferred embodiment of a vehicular lighting system in the present invention, as shown in FIG. 1-7, includes a housing 1, an optical panel 2 and a heat-dissipating member 3 as main components combined together.

The housing 1 made of heat dissipating material(s) can be used as a sealing member as well as be used to dissipate heat for the LED lamp installed in the interior of the vehicular lighting system. The external appearance of the housing 1 can be changed for matching needs of every sort of vehicular lighting system, not restricted to the look shown in the Figs. The housing 1 has its inner surface provided with an optical reflecting surface 10 for reflecting the light produced by the LED lamps to have the light passing through the optical panel 2 and projected outward for lighting. The housing 1 has its rear side disposed with an extension portion 11 provided with a line passageway 110 for various categories of wires to be inserted there-through to have the LED lamps connected with a control circuit board 12, with the control circuit board 12 functioning to switch on and off the LED lamps. The control circuit board 12 is positioned at the outer side of the extension portion 11 and secured at the inner side of a cover plate 13 by bolts 120 and then, the cover plate 13 and the extension portion 11 of the housing 1 are combined together by bolts 130, thus having water-proof effect and able to protect both the control circuit board 12 and the LED lamps from getting wet. Further, the housing 1 is formed with a combination groove 14 at a location of the outermost circumference of the optical reflecting surface 10, and the combination groove 14 matches with the shape of the optical panel 2 so that adhesive waterproof material can be filled in the combination groove 14 of the lamp housing to combine the optical panel 2 and the combination groove 14 of the lamp housing together for attaining hermetic and damp-proof effects.

Figure 2:
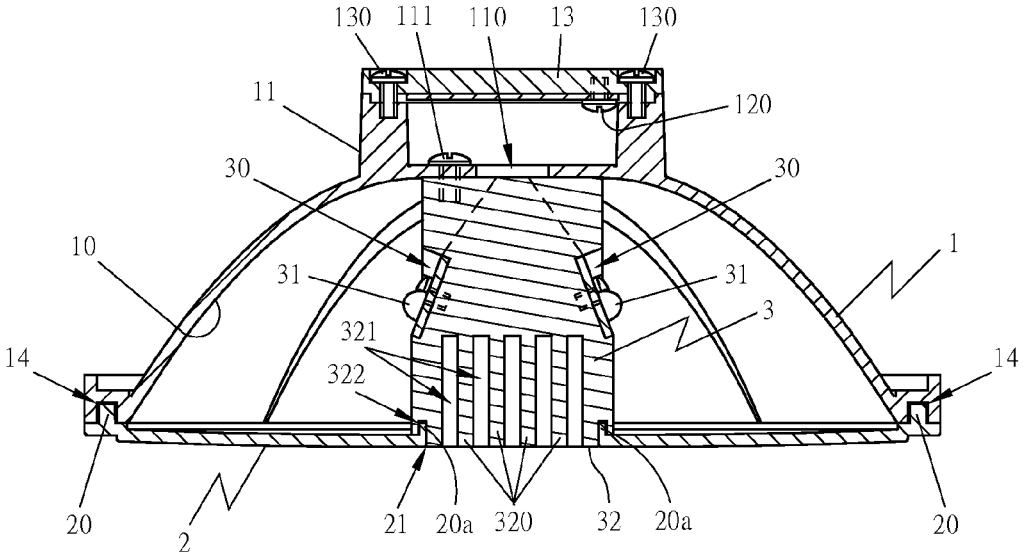
FIG. 2 is a cross-sectional view of the line A-A in FIG. 1.
Figure 3:
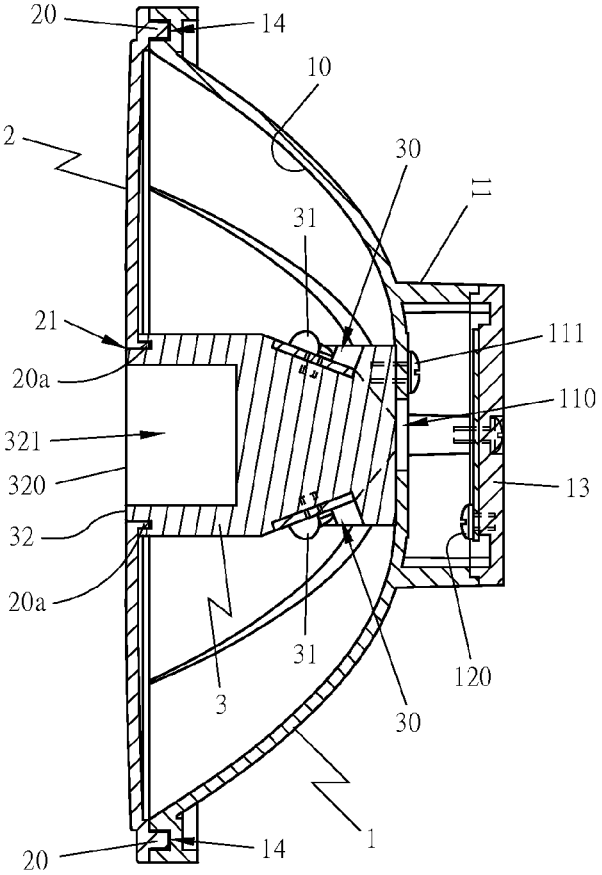
FIG. 3 is a cross-sectional view of the line B-B in FIG. 1.
Figure 4:
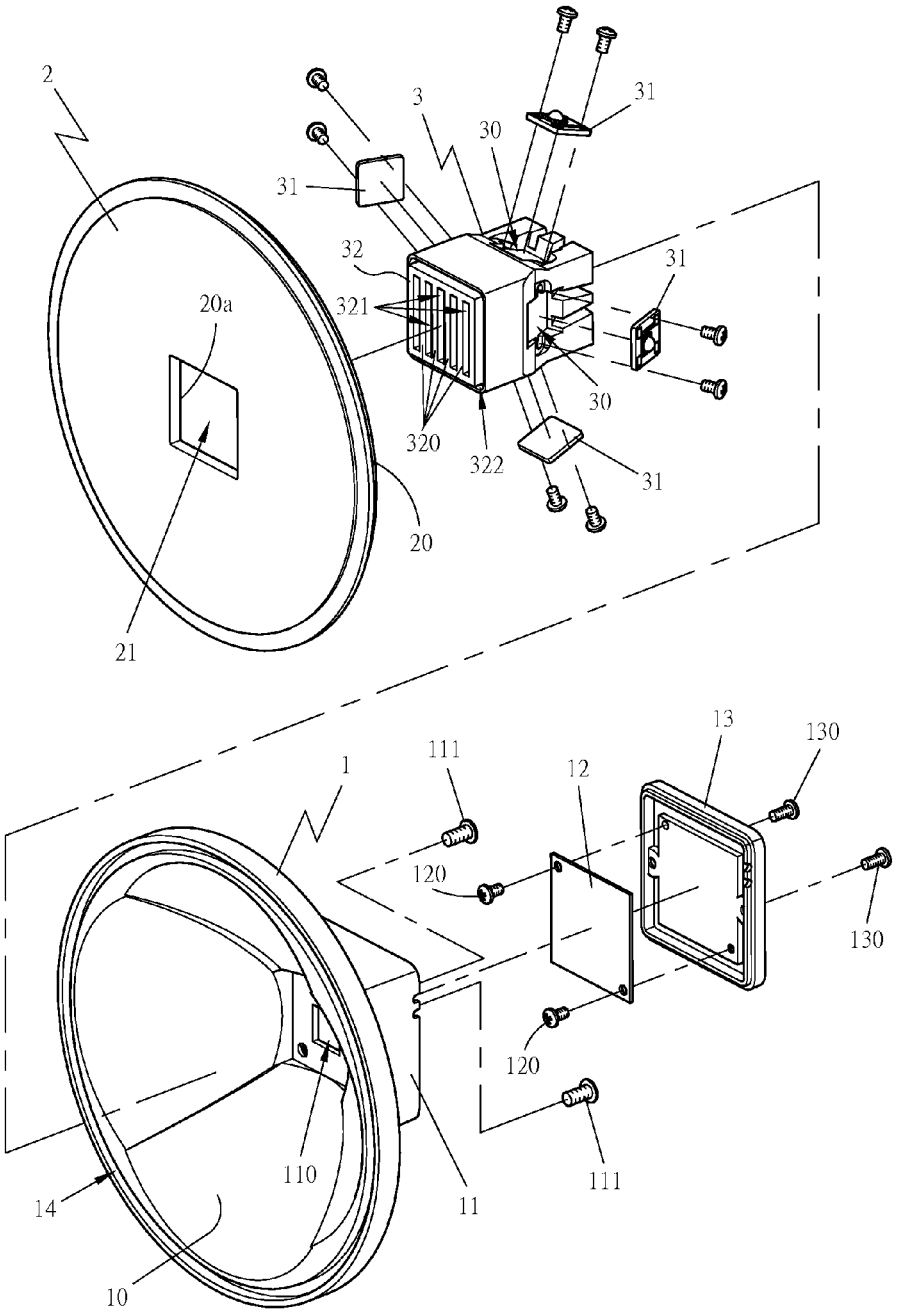
FIG. 4 is an exploded perspective view of the first preferred embodiment of the vehicular lighting system in the present invention.
Figure 7:
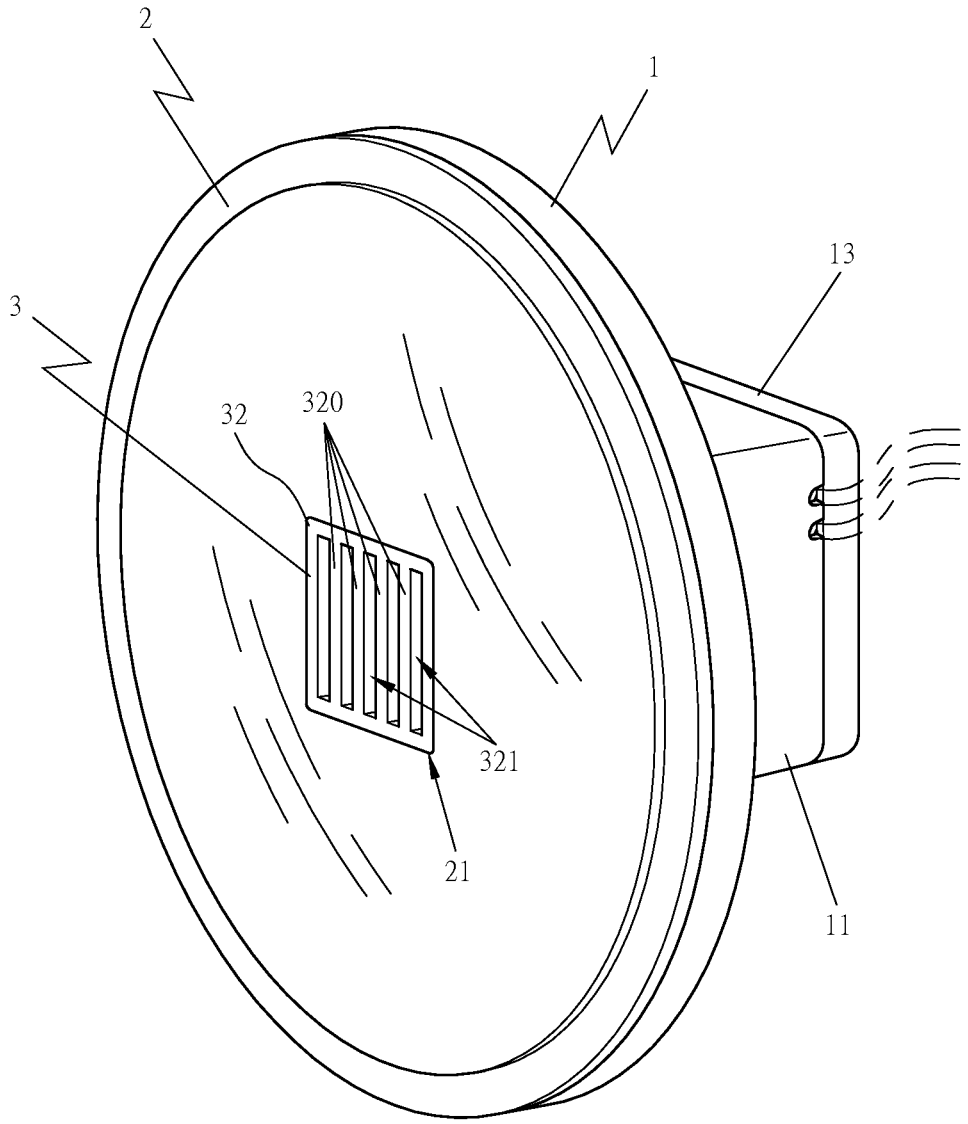
FIG. 7 is a perspective view of the first preferred embodiment of the vehicular lighting system in the present invention.
Figure 8:
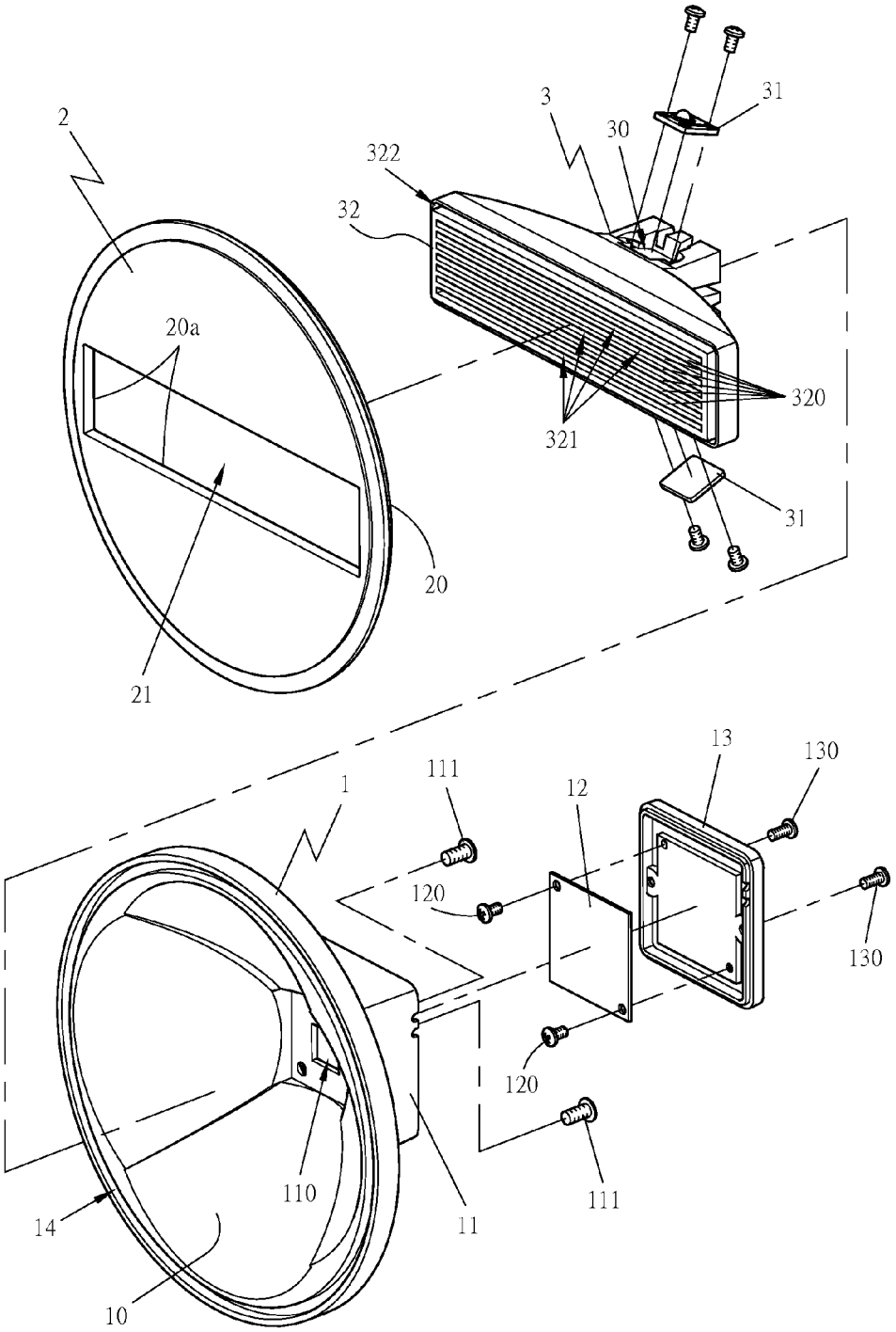
FIG. 8 is an exploded perspective view of a second preferred embodiment of a vehicular lighting system in the present invention.
Figure 9:
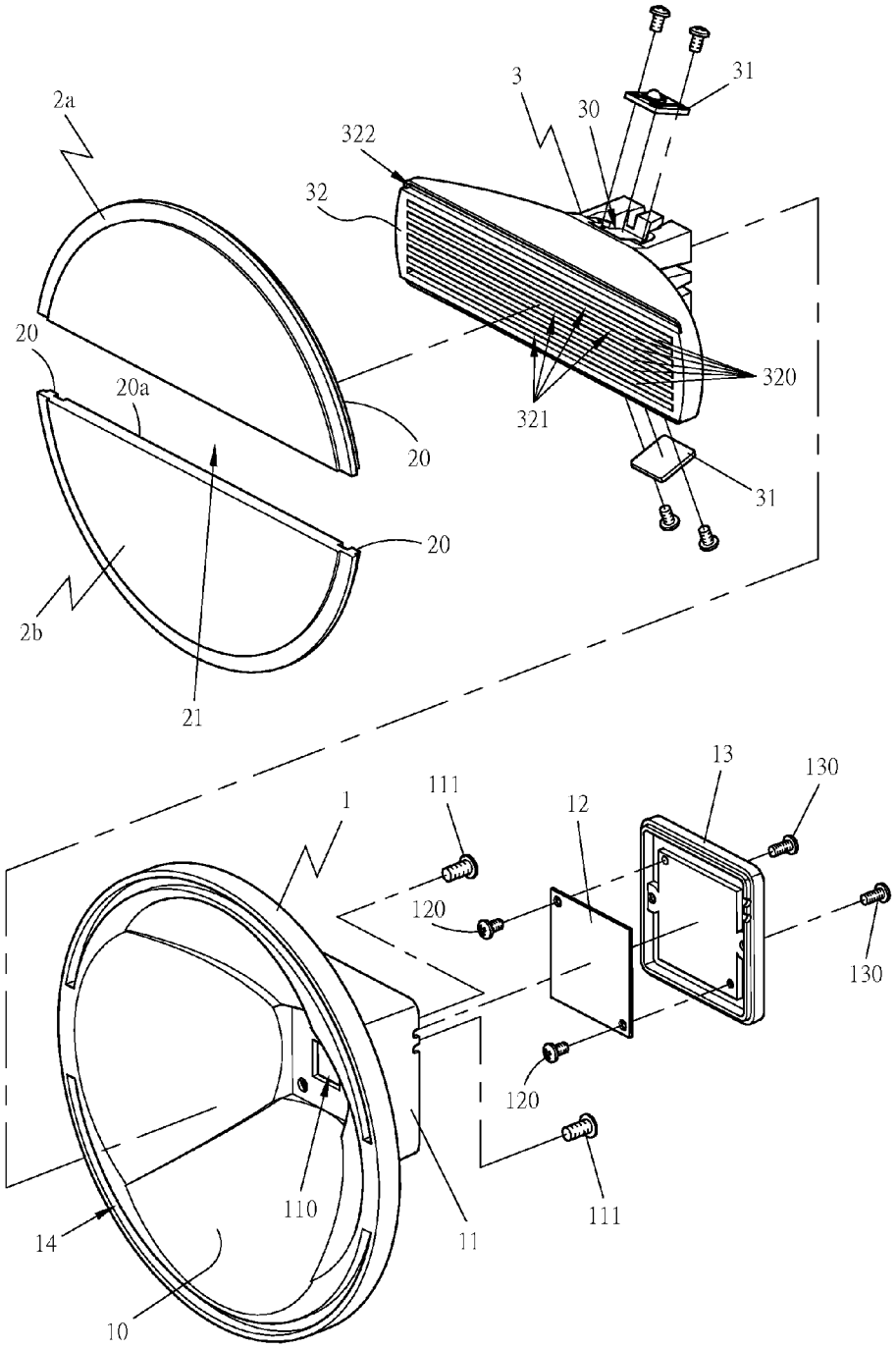
FIG. 9 is an exploded perspective view of a third preferred embodiment of a vehicular lighting system in the present invention

The optical panel 2 is preferably made of material of light transmission so that light produced by LED lamps is able to pass through the optical panel 2 for lighting. The optical panel 2 can be one single piece, as shown in FIGS. 4 and 8, or two pieces, as shown in FIG. 9, or composed of plural pieces. The optical panel 2 has the circumferential edge of its inner side provided with an outer combination member 20 to be firmly combined together with the combination groove 14 of the lamp housing, as shown in FIGS. 2 and 3, able to attain hermetic and damp-proof effects. Furthermore, the optical panel 2 is disposed with one reserved space 21, or two or more than two reserved spaces 21 for matching with a provided condition of the auxiliary heat sink of the heat-dissipating member 3, and the reserved space 21, whether one, two or more, can be of a square shape, as shown in FIGS. 4 and 7, a triangular shape, a round shape, a rhombic shape, a rectangular shape, as shown in FIG. 8, a cross shape, an X shape, or an irregular shape in accordance with the conditions of the auxiliary heat sink of the heat-dissipating member 3. The reserved space 21 can also be formed and sandwiched between two or more optical panels 2*a* and 2*b*, as shown in FIG. 9. Substantially, the reserved space 21 is not restrictedly provided at a central portion of the optical panel 2, and the reserved space 21 can be provided at the circumference of the optical panel 2 adjacent to the housing 1. In brief, in this invention, the location of the reserved space 21 provided on the optical panel 2 is not restricted. To enable the optical panels 2, 2*a*, 2*b* to be closely combined with the auxiliary heat sink of the heat-dissipating member 3, the optical panel 2 is fixed with an inner combination member 20*a* at the location of the inner peripheral side of the reserved space 21 for matching the combination grooves of the auxiliary heat sink of the heat-dissipating member 3 and then, adhesive waterproof material is filled in the combination grooves to have the inner combination member 20*a* and the combination grooves of the auxiliary heat sink of the heat-dissipating member 3 combined together, thus producing the hermetic and damp-proof effects.

Figure 5:
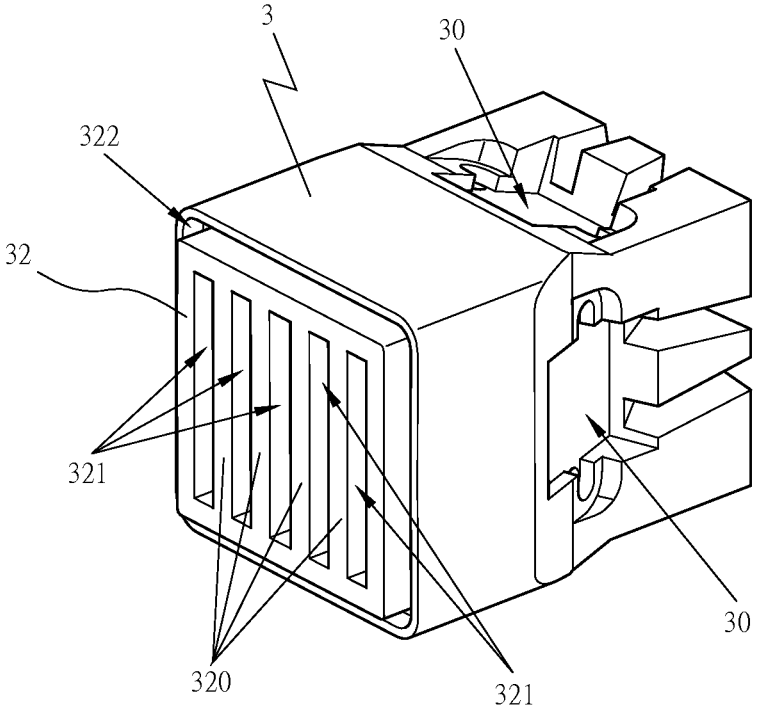
FIG. 5 is a perspective view of a heat-dissipating member of the first preferred embodiment of the vehicular lighting system in the present invention.
Figure 6:
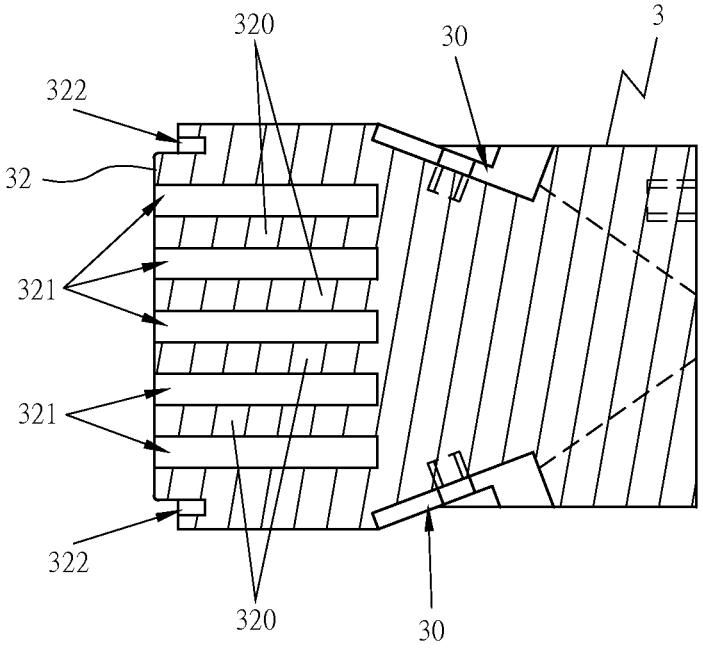
FIG. 6 is a cross-sectional view of the heat-dissipating member of the first preferred embodiment of the vehicular lighting system in the present invention.

Referring to FIGS. 2-4, the heat-dissipating member 3 is fixed at a front side of the extension portion 11 of the housing 1 by bolts 111 and disposed with LED lamp grooves 30 for receiving LED lamps 31 and the LED lamp grooves 30 are provided to match with the number of the LED lamps 31. The heat-dissipating member 3 has its front end provided with the auxiliary heat sink 32, which can be a square shape, as shown in FIGS. 4 and 7, a triangular shape, a round shape, a rhombic shape, a rectangular shape, as shown in FIG. 8, a cross shape, an X shape or an irregular shape for matching the shape and state of the reserved space 21 of the optical panel 2. The purpose of having the auxiliary heat sink is for increasing a heat dissipation area so that the outside air will pass through the interval space 321 between every two small fins 320 of the auxiliary heat sink 32 and take the heat away when a vehicle is moving, as shown in FIGS. 5 and 6, the normal-temperature outside air and the auxiliary heat sink 32 can produce a maximum contact area for elevating heat dissipation effect. Of course, the auxiliary heat sink 32 is not restrictedly formed into a fin shape, it can also be formed into a lump shape so long as the auxiliary heat sink 32 can produce an effect of heat dissipation. In this invention, the auxiliary heat sink 32 of the heat-dissipating member 3 is positioned at the outer side of a whole vehicular lighting system so it can produce optimum heat dissipation efficiency and hence, the LED lamps are able to maintain proper operating temperature, produce excellent photoelectric conversion efficiency and offer the best illumination and thus maintain due service life of the vehicular lighting systems. The auxiliary heat sink 32 is formed with combination grooves 322, as shown in FIGS. 5 and 6, and adhesive waterproof material is filled in the combination grooves 322 to have the inner combination member 20*a* of the optical panel 2 and the combination grooves 322 of the auxiliary heat sink 32 combined together to produce airtight and damp-proof effects.

In this invention, the heat-dissipating member 3 and the auxiliary heat sink portion 32 can be formed integrally, or the heat-dissipating member 3 and the auxiliary heat sink 32 respectively can be an independent member to be combined together by bolts or by adhesive heat-dissipation material. Thus, heat source, which is produced by the LED lamps and absorbed by the heat-dissipating member 3, can directly be guided and dissipated, equally attaining effect of quickly dissipating heat.

The special feature of this invention is that the optical panel 2 is provided with the reserved space to enable the auxiliary heat sink 32 of the heat-dissipating member 3 to be mounted at a front surface of a vehicular lighting system for directly contacting with normal-temperature outside air. Thus, heat source produced by the LED lamps can be guided by the heat-dissipating member 3, and directly and quickly dissipated by the auxiliary heat sink 32 that contacts with the normal-temperature outside air and, of course, a part of the heat source still has to be dissipated via the housing 1. By so designing, the vehicular lighting system of this invention offers multiple heat dissipation channels and thus able to enhance heat dissipation efficiency and insure due photo-electric conversion efficiency of the LED lamps, and also able to maintain a due normal weakening period of the LED lamps and prolong service life of the vehicular lighting systems. Evidently this invention has tangible benefits and tallies with progressiveness and novelty demanded by patent laws.

While the preferred embodiments of this invention have been described above, it will be recognized and understood that various modifications may be made therein and appended claims are intended to cover all such modifications that may fall within the spirit and scope of the invention.

What is claimed is:

1. A vehicular lighting system at least comprising a housing, said housing having a front end secured with an optical panel, said optical panel formed with a reserved space, a heat-dissipating member installed with LED lamps, said heat-dissipating member having a front end provided with an auxiliary heat sink, said auxiliary heat sink portion extending to said reserved space of said optical panel, said heat-dissipating member combined with said optical panel to produce hermetic and damp-proof effects, said auxiliary heat sink directly contacting with normal-temperature outside air to directly dissipate heat for enhancing heat dissipation efficiency of said LED lamps;

wherein said reserved space of said optical panel has an inner side of a circumferential edge disposed with inner combination members for matching said combination grooves of said auxiliary heat sink of said heat-dissipating member to have said optical panel combined together with said auxiliary heat sink of said heat-dissipating member.

2. The vehicular lighting system as claimed in claim 1, wherein said housing has an inner surface provided with an optical reflecting surface, said optical reflecting surface reflecting light produced by said LED lamps, said light passing through said optical panel and projected outward for lighting, said housing having a rear side disposed with an extension portion, said extension portion having an outer side fixed with a control circuit board, said control circuit board assembled at an inner side of a cover plate by bolts, said cover plate combined together with said extension portion of said housing by bolts, said housing having an outer circumference formed with combination grooves, said combination grooves matching with a shape of said optical panel, adhesive waterproof material filled in said combination grooves for combining said optical panel together with said combination grooves of said housing.

3. The vehicular lighting system as claimed in claim 1, wherein said optical panel can be one single piece or two pieces or composed of plural pieces, the number of said reserved space of said optical panel being one or two or more for matching a provided condition of said auxiliary heat sink of said heat-dissipating member, said reserved space positioned at a central portion of said optical panel or at a circumference of said optical panel, adjacent to said housing.

4. The vehicular lighting system as claimed in claim 1, wherein said optical panel has a circumferential edge of an inner side fixed with outer combination members to be combined with said combination grooves of said housing to produce airtight and damp-proof effects.

5. The vehicular lighting system as claimed in claim 1, wherein said reserved space of said optical panel is of a square shape, a triangular shape, a round shape, a rhombic shape, a rectangular shape, a cross shape, an X shape or an irregular shape for matching a shape of said auxiliary heat sink of said heat-dissipating member.

6. The vehicular lighting system as claimed in claim 1, wherein said reserved space of said optical panel is formed and sandwiched between two or more said optical panels.

7. The vehicular lighting system as claimed in claim 1, wherein said heat-dissipating member is threadably secured at a front side of said extension portion of said housing by bolts, said heat-dissipating member formed with an LED lamp groove for receiving an LED lamp therein.

8. The vehicular lighting system as claimed in claim 1, wherein said auxiliary heat sink of said heat-dissipating member is of a square shape, a triangular shape, a round shape, a rhombic shape, a rectangular shape, a cross shape, an X shape or an irregular shape for matching a shape and state of said reserved space of said optical panel.

9. The vehicular lighting system as claimed in claim 1, wherein said auxiliary heat sink of said heat-dissipating member is provided with a plurality of small fins and an interval space is formed between every two said small fins.

10. The vehicular lighting system as claimed in claim 1, wherein said auxiliary heat sink of said heat-dissipating member is lump-shaped.

11. A vehicular lighting system at least comprising a housing, said housing having an inner surface provided with an optical reflecting surface, said optical reflecting surface reflecting light produced by said LED lamps and then the light passing through an optical panel and projected outward, said optical panel provided with a reserved space, said reserved space of said optical panel having peripheral edges combined with an auxiliary heat sink of a heat-dissipating member for producing hermetic and damp-proof effects, said heat-dissipating member firmly fixed between said housing and said optical panel, said heat-dissipating member disposed with LED lamp grooves for reserving LED lamps therein, said heat-dissipating member provided with said auxiliary heat sink, said auxiliary heat sink extending in said reserved space of said optical panel and combined with said optical panel, said auxiliary heat sink contacting with outside air of normal temperature for enhancing heat dissipation effect of said LED lamps.

12. The vehicular lighting system as claimed in claim 11, wherein said housing has a rear side formed with an extension portion, said extension portion having an outer side installed thereon with a control circuit board, said control circuit board threadably assembled at an inner side of a cover plate by bolts, said cover plate combined together with said extension portion of said housing with bolts, said housing having an outer circumference formed with a combination groove, said combination groove matching with a shape of said optical panel, adhesive water-proof material filled in said combination groove to combine said optical panel together with said combination groove of said housing.

13. The vehicular lighting system as claimed in claim 11, wherein said optical panel is a single piece or two pieces or composed of plural pieces, the number of said reserved space of said optical panel being one or two or more in accordance with a provided condition of said auxiliary heat sink of said heat-dissipating member, said reserved space provided at a central portion of said optical panel or positioned at a circumference of said optical panel adjacent to said housing.

14. The vehicular lighting system as claimed in claim 11, wherein said optical panel has an inner circumferential edge provided with an outer combination member to be combined with said combination groove of said housing to produce hermetic and damp-proof effects.

15. The vehicular lighting system as claimed in claim 11, wherein said reserved space of said optical panel is of a square shape, a triangular shape, a round shape, a rhombic shape, a rectangular shape, a cross shape, an X shape or an irregular shape for matching a shape of said auxiliary heat sink portion of said heat-dissipating member.

16. The vehicular lighting system as claimed in claim 11, wherein said reserved space of said optical panel is sandwiched between two or more optical panels.

17. The vehicular lighting system as claimed in claim 11, wherein said reserved space of said optical panel has an inner side of a circumferential edge disposed with inner combination members for matching with said combination grooves of said auxiliary heat sink portion of said heat-dissipating member to have said optical panel combined together with said auxiliary heat sink of said heat-dissipating member.

18. The vehicular lighting system as claimed in claim 11, wherein said heat-dissipating member is secured at a front side of said extension portion of said housing by bolts, and said heat-dissipating member is provided with LED lamp grooves for receiving LED lamps.

19. The vehicular lighting system as claimed in claim 11, wherein said auxiliary heat sink of said heat-dissipating member is of a square shape, a triangular shape, a round shape, a rhombic shape, a rectangular shape, a cross shape, an X shape or an irregular shape for matching a shape and condition of said reserved space of said optical panel.

20. The vehicular lighting system as claimed in claim 11, wherein said auxiliary heat sink of said heat-dissipating member is formed with a plurality of small fins and an interval space is formed between every two said small fins.

21. The vehicular lighting system as claimed in claim 11, wherein said auxiliary heat sink is lump-shaped.

22. A vehicular lighting system at least comprising a housing, said housing having a front end secured with an optical panel, said optical panel formed with a reserved space, a heat-dissipating member installed with LED lamps, said heat-dissipating member having a front end provided with an auxiliary heat sink, said auxiliary heat sink portion extending to said reserved space of said optical panel, said heat-dissipating member combined with said optical panel to produce hermetic and damp-proof effects, said auxiliary heat sink directly contacting with normal-temperature outside air to directly dissipate heat for enhancing heat dissipation efficiency of said LED lamps;

wherein said auxiliary heat sink of said heat-dissipating member is provided with a plurality of small fins and an interval space is formed between every two said small fins.

* * * * *